US008213655B2

(12) United States Patent
Kral et al.

(10) Patent No.: US 8,213,655 B2
(45) Date of Patent: Jul. 3, 2012

(54) HEARING DEVICE TO BE WORN BEHIND AN EAR

(75) Inventors: Holger Kral, Fürth (DE); Stefanie Preusche, Erlangen (DE); Joseph Sauer, Strullendorf (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1025 days.

(21) Appl. No.: 12/150,952

(22) Filed: May 1, 2008

(65) Prior Publication Data

US 2008/0273730 A1 Nov. 6, 2008

(30) Foreign Application Priority Data

May 4, 2007 (DE) ..... 10 2007 021 034

(51) Int. Cl.
*H04R 25/00* (2006.01)

(52) U.S. Cl. ..... 381/322; 381/69; 381/68; 361/816

(58) Field of Classification Search ..... 381/312–330
See application file for complete search history.

(56) References Cited

U.S. PATENT DOCUMENTS

| | | | | |
|---|---|---|---|---|
| 5,062,138 | A * | 10/1991 | Schmid | 381/323 |
| 5,249,234 | A * | 9/1993 | Butler | 381/322 |
| 7,267,847 | B2 * | 9/2007 | Karamuk | 427/569 |
| 2004/0120539 | A1 * | 6/2004 | Panitzsch | 381/312 |
| 2006/0216498 | A1 * | 9/2006 | Chen | 428/328 |
| 2007/0271975 | A1 | 11/2007 | Seidel | |

FOREIGN PATENT DOCUMENTS

| | | | |
|---|---|---|---|
| CH | 689 685 | A5 | 8/1999 |
| DE | 103 42 664 | A1 | 4/2005 |
| WO | WO 00/13330 | A1 | 3/2000 |

* cited by examiner

*Primary Examiner* — Steven Loke
*Assistant Examiner* — David Goodwin

(57) ABSTRACT

For individual coloring of the housing of the hearing device, a hearing device containing electromechanical and/or electronic components is provided. The components are accommodated in a divided housing, with the housing being constructed from an upper shell, a first lower shell and a second lower shell which can be releasably fastened to the first lower shell.

16 Claims, 5 Drawing Sheets

HEARING DEVICE TO BE WORN BEHIND AN EAR

CROSS REFERENCE TO RELATED APPLICATIONS

This application claims priority of German application No. 10 2007 021 034.7 DE filed May 4, 2007, which is incorporated by reference herein in its entirety.

FIELD OF THE INVENTION

The invention relates to a hearing device, in particular to be worn behind an ear, containing electromechanical and/or electronic components, which are accommodated in a divided housing.

BACKGROUND OF THE INVENTION

The patent specification CH 689 685 A5 discloses a hearing device, the housing of which is essentially formed from two parts, namely from two housing shell halves, which fix onto a frame and form an approximately sickle or banana-shaped housing. Each housing shell forms an approximately equally sized lateral part of the hearing device, with it being possible to insert faceplates with different receiving openings between the housing shells, which are configured so as to be lockable with the frame. Different functional or control elements of the hearing device, such as for instance a volume controller, an on/off switch, a programming socket or a situation changeover switch are assigned to the receiving openings. Similarly, the housing shells can be fastened against the frame in various shapes or colors. Screws or releasable lock connections can be provided for fastening purposes.

This design of the housing consisting essentially of two housing shell halves, namely the housing shells forming the side elements and at least one cover strip, is however complicated. Thus on the one hand, a more complex and thus more expensive frame is needed. On the other hand, the mounting of the housing shells in conjunction with the at least one cover strip proves to be difficult, since attention must always be paid to the partially very sensitive electromechanical and electronic components. A partial or complete color change of the housing is thus associated with high outlay.

With hearing devices, it is also known only to change the color of the upper shell, since the individual components are mounted in the lower shell in order to avoid a complex frame. The then existing neutrally colored part of the lower shell is however perceived as objectionable. A design compromise was thus previously accepted, whereby the lower shell is kept unchanged in a neutrally colored part and only the upper shell is exchanged. A complete changeover of the housing color of the hearing device is thus not possible. In any case, the frame construction is again complex and thus expensive.

DE 103 42 664 A1 also discloses an electronic key for a locking system of a motor vehicle. In a peripheral direction of a flat housing of the electronic key, a design element embodied as a separate component is fastened to at least two border areas of the housing, said design element being of a colored design. Here a design element is able to fasten two housing shell halves of the housing to one another and can be non-releasably connected to the housing of the electronic key, as defined by the manufacturer.

WO 00/13330 discloses a protective housing for a functional mobile telephone, with the protective housing having at least two plastic housing halves which can be locked into one another. As a result, the mobile telephone can be completely accommodated in the protective housing. The mobile telephone with the protective housing thus has two housings arranged one above the other and protecting an electronic system of the mobile telephone, on the one hand a housing for the mobile telephone and on the other hand the protective housing disposed thereabove.

SUMMARY OF INVENTION

The object of the invention is on the other hand to enable a partial or complete exchange of the housing in as simple a fashion as possible and without the use of a complex frame. Furthermore, individual two-tone design combinations are to be enabled in a simple fashion.

The object is achieved by a hearing device, in particular to be worn behind an ear, having the features of the independent claims.

It is proposed in accordance with the invention to assemble the housing from an upper shell, a first lower shell and a second lower shell which can be releasably fastened to the first lower shell. The shape of the second lower shell largely corresponds to the shape of the first lower shell, so that when the second lower shell is assembled on the first lower shell, the second lower shell almost completely covers the first lower shell. This thus advantageously results in an almost complete color change of the lower side of the housing, when the second lower shell is attached.

It is very advantageous for the sensitive electronics system not to have to be changed over during a housing change. A new marketing concept is possible as a result of a simple attachment of a second lower shell to the first lower shell, since psychologically for the hearing device acoustician, this is not a question of a reconstruction of the housing but instead of merely a special lower shell, almost a color-click-shell. This special lower shell, the "click-cover", advantageously also prevents the hearing device from appearing larger, since the slim housing part is the upper housing part and/or the upper shell.

Further advantages and advantageous embodiments of the invention result from the dependent claims and the description.

In one embodiment of the invention, the second lower shell is releasably fastened to the first lower shell by means of a frictional connection. This can be effected by means of an elastic deformation of the second lower shell. It is also possible to effect the releasable fastening by means of tensioning or applying pressure to or such like the second lower shell made of elastic material on the first lower shell. The simple assembly and disassembly of the second lower shell onto/from the first lower shell is particularly advantageous.

In a further embodiment of the invention, the upper shell and the first lower shell are releasably connected to one another by means of a locking connection and/or snap-on connection and/or suchlike. An exchange of the upper shell is thus also possible in a simple manner, as a result of which a complete color change of the housing can be carried out in a simple fashion.

A further embodiment of the invention provides for a housing element on the front face which can be introduced into the first lower shell. The housing element has a hook receptacle, which hooks onto a hook element provided on the first lower shell. The releasable connection of the upper shell to the first lower shell can thus be improved further.

In a further embodiment of the invention, the housing color of the hearing device can be of a changeable design as a result of exchanging the second lower shell. This allows for individual two-tone design combinations of the housing in a simple fashion.

In a further embodiment of the invention, the upper shell can also be designed to be exchangeable for changeable color design purposes. This allows the color of the housing to be completely changed very easily.

In a further embodiment of the invention, the second lower shell has a shape which can be individually adjusted to an ear. To this end, the second lower shell is advantageously made of a soft plastic. The use of a soft plastic enables the shape of the second lower shell to be designed individually, e.g. according to a concha molding or a concha scanning, so that pressure points can be avoided for the hearing device wearer.

In a further embodiment of the invention, the second lower housing has a smooth and/or coated surface. Contamination of the housing can thus be counteracted in a very advantageous fashion.

In a further embodiment of the invention, the coated surface consists of a nano-coating.

BRIEF DESCRIPTION OF THE DRAWINGS

One exemplary embodiment of the invention is described in more detail in the description that follows and is clarified further on the basis of the drawings, in which.

DETAILED DESCRIPTION OF INVENTION

Figure 1:
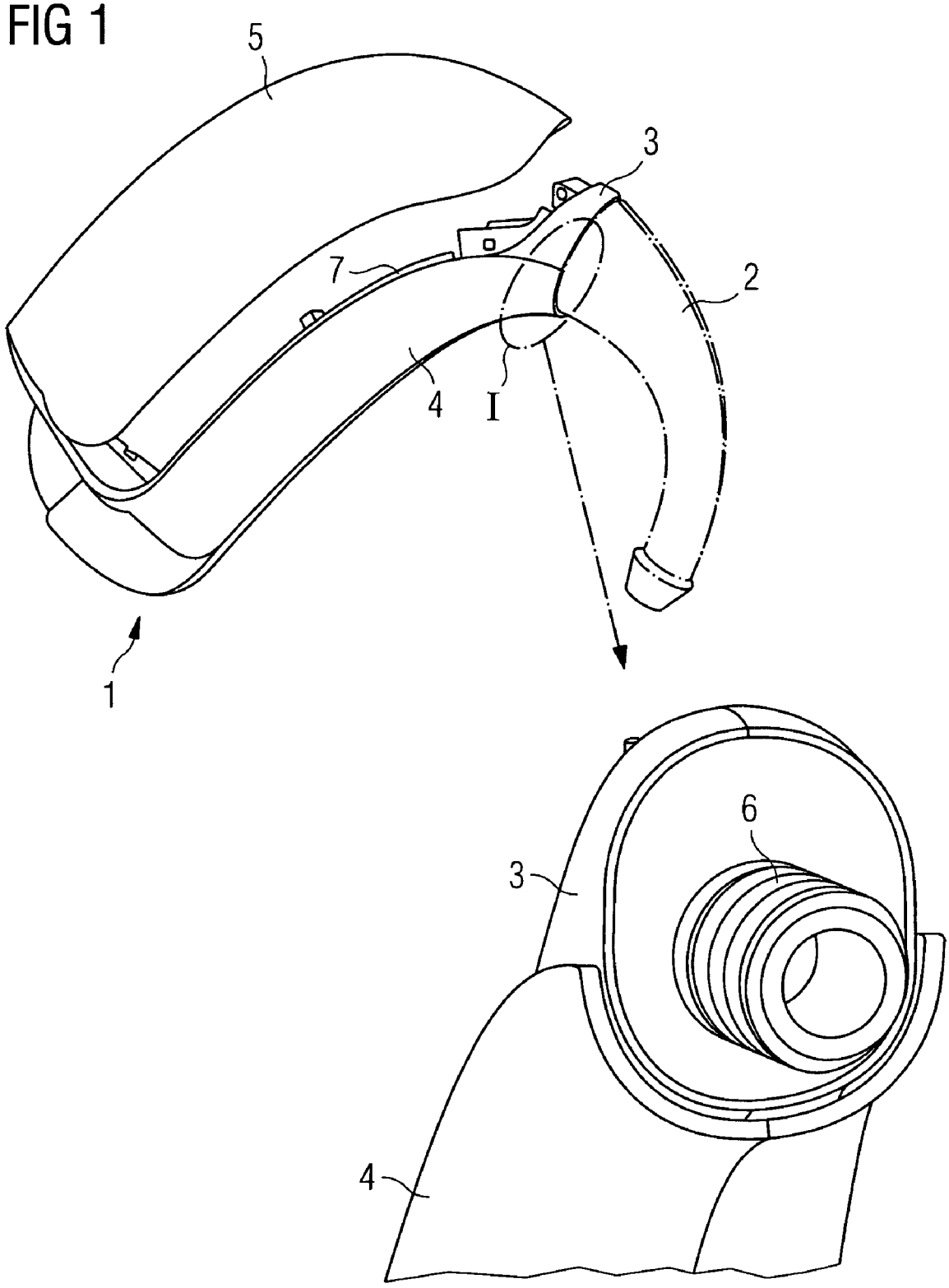
FIG. 1 shows a perspective illustration of a housing of an inventive hearing device having the housing elements; upper shell, first and second lower shells as well as a carrier bar shown with a dashed line and in addition shows an illustration of an enlarged cut-out without a carrier bar as per border strip I.
Figure 2:
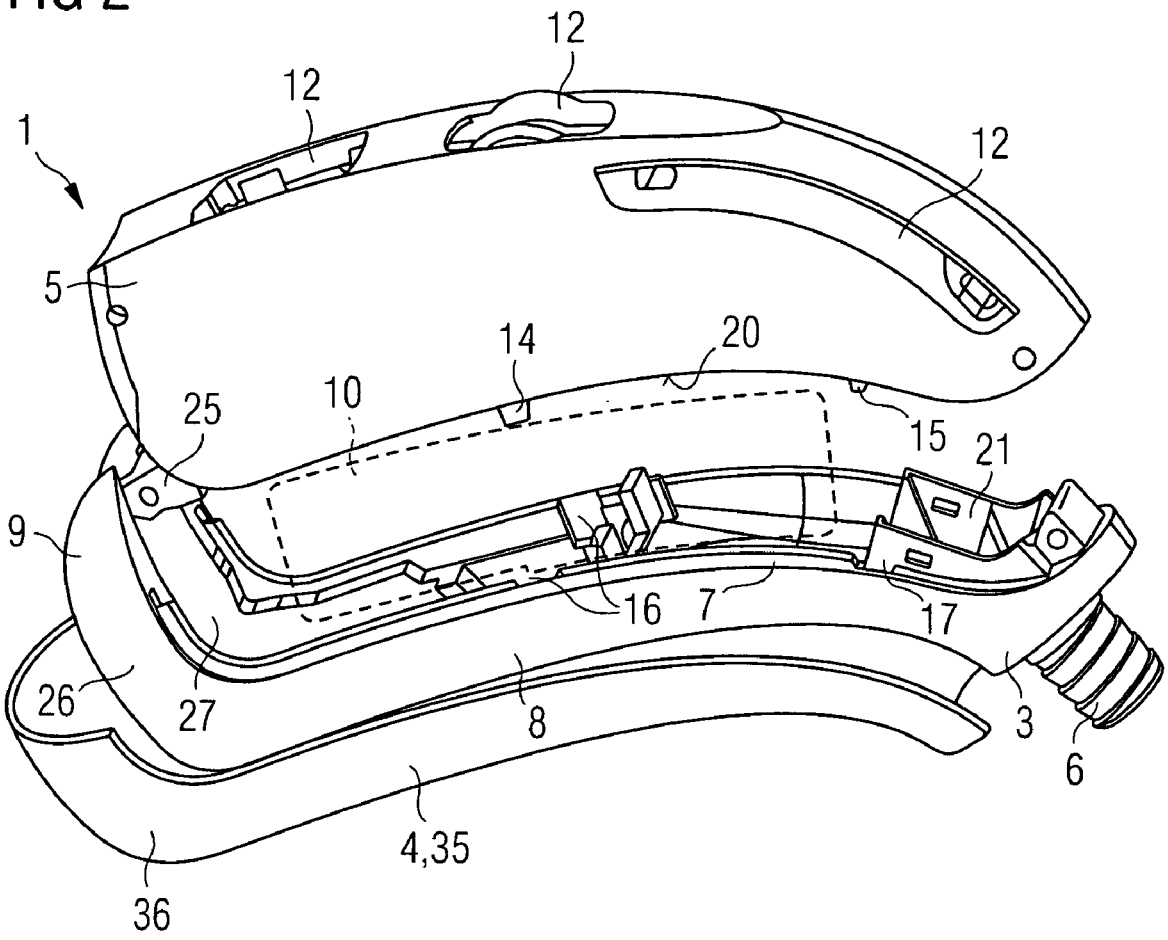
FIG. 2 shows a perspective illustration of the housing of the inventive hearing device having the housing elements; upper shell and first and second lower shells.
Figure 3:
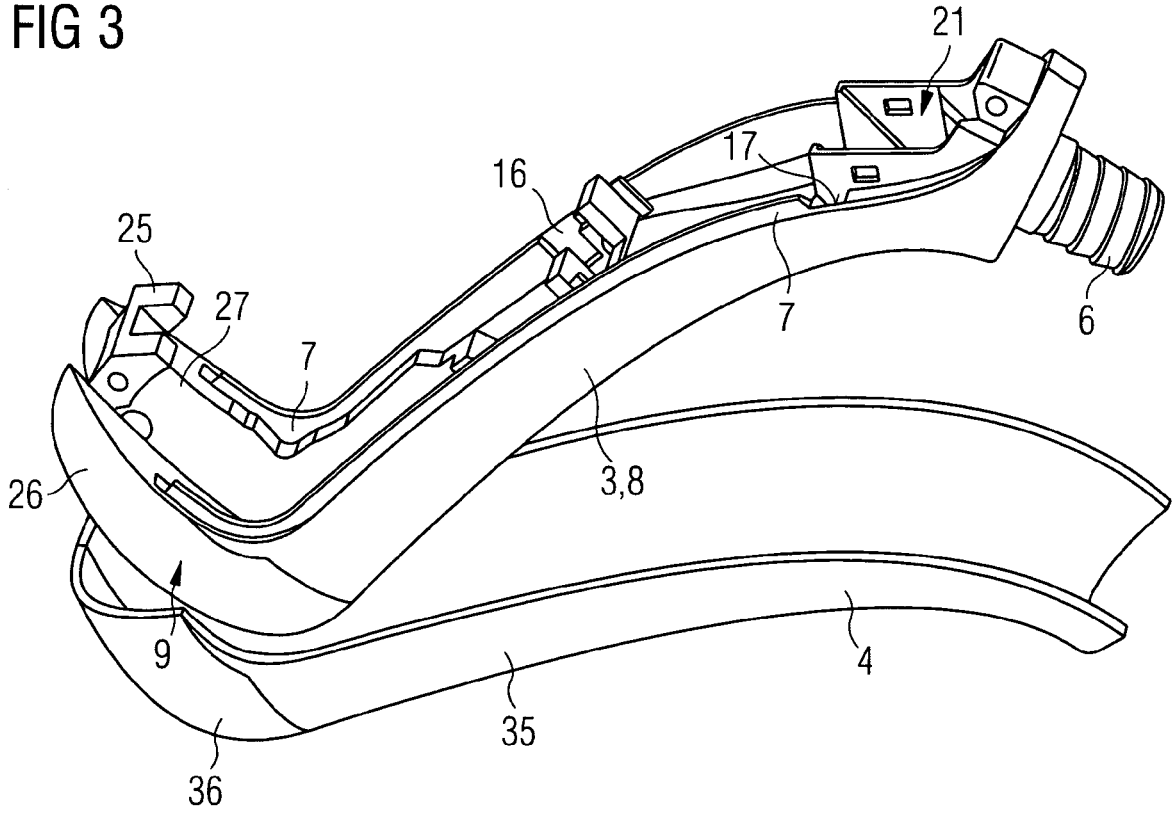
FIG. 3 shows a perspective illustration of the housing of the inventive hearing device having the housing elements; first and second lower shell.

FIG. 1 shows a perspective illustration of a housing 1 of a hearing device to be worn behind a human ear, which has a carrier bar 2 (shown with a dashed line), which is used in a known manner to connect a sound tube (not shown) to the connecting ear adjusting piece. As shown in FIG. 2, the housing 1 essentially has three elements, namely a first lower shell 3, a second lower shell 4 and an upper shell 5.

The first lower shell 3 is preferably made of plastic and has a frame 7 embedded in plastic for instance. The partially rail-shaped frame 7 is used to mount and hold electrical and electronic hearing device components 10 (not shown in more detail, but indicated with a dashed line in FIG. 2), such as a microphone, receiver, amplifier unit, battery, volume controller, on/off switch, programming socket etc. The first lower shell 3 thus represents the main housing component 3 of the hearing device, which is not exchangeable.

The upper shell 5 is connected to the first lower shell 3. The upper shell 5 at least partially covers the electrical and electromechanical hearing device components 10 and has several openings 12, in order for instance to externally trigger the on/off switch, the volume controller etc. for activation purposes.

A releasable connection, in particular in the form of a locking and/or snap-on connection, is provided in order to connect the upper shell 5 to the first lower shell 3. As shown in FIG. 2 and in FIG. 4, a number of lugs are embodied, for instance a first group of first lugs 14 and a second group of second lugs 15. The first lugs 14 and second lugs 15 protrude in pairs opposite one another in each instance from a lower side 20 of the upper shell 5. As shown in FIG. 2, the first lug group 14 engages in a first locking region 16 which is recessed from the frame 7 and the second lug group 15 engages in a second locking region 17 which is recessed from frame 7.

The first, non-exchangeable lower shell 3 has a carrier bar connection 6 on its front face for the carrier bar 2 (not shown). The first lower shell 3 has a pin-like element 21 on its interior opposite the carrier bar connection 6, said element 21 correspondingly engaging into a pin receptacle 22 embodied in the plastic of the upper shell 3 and shown in FIG. 4 when the upper shell 5 fixes to the first lower shell 3 and hooks or locks thereonto for instance. The continuous, releasable fastening is then carried out by way of the lug groups 14, 15 and their corresponding locking regions 16, 17 in the frame 7 by means of locking the upper shell 5 to the first lower shell 3 and/or its frame 7.

The first lower shell 3 is embodied in the manner of a boot and/or angled and has a longish base element and a shaft element 9 as a longer and shorter leg respectively. The shaft element 9 has an open face side, so that two side walls 26, 27, which are easily visible in FIG. 2, are present, with a hook element 25 connecting both side walls 26, 27 being provided between the side walls 26, 27.

Figure 4:
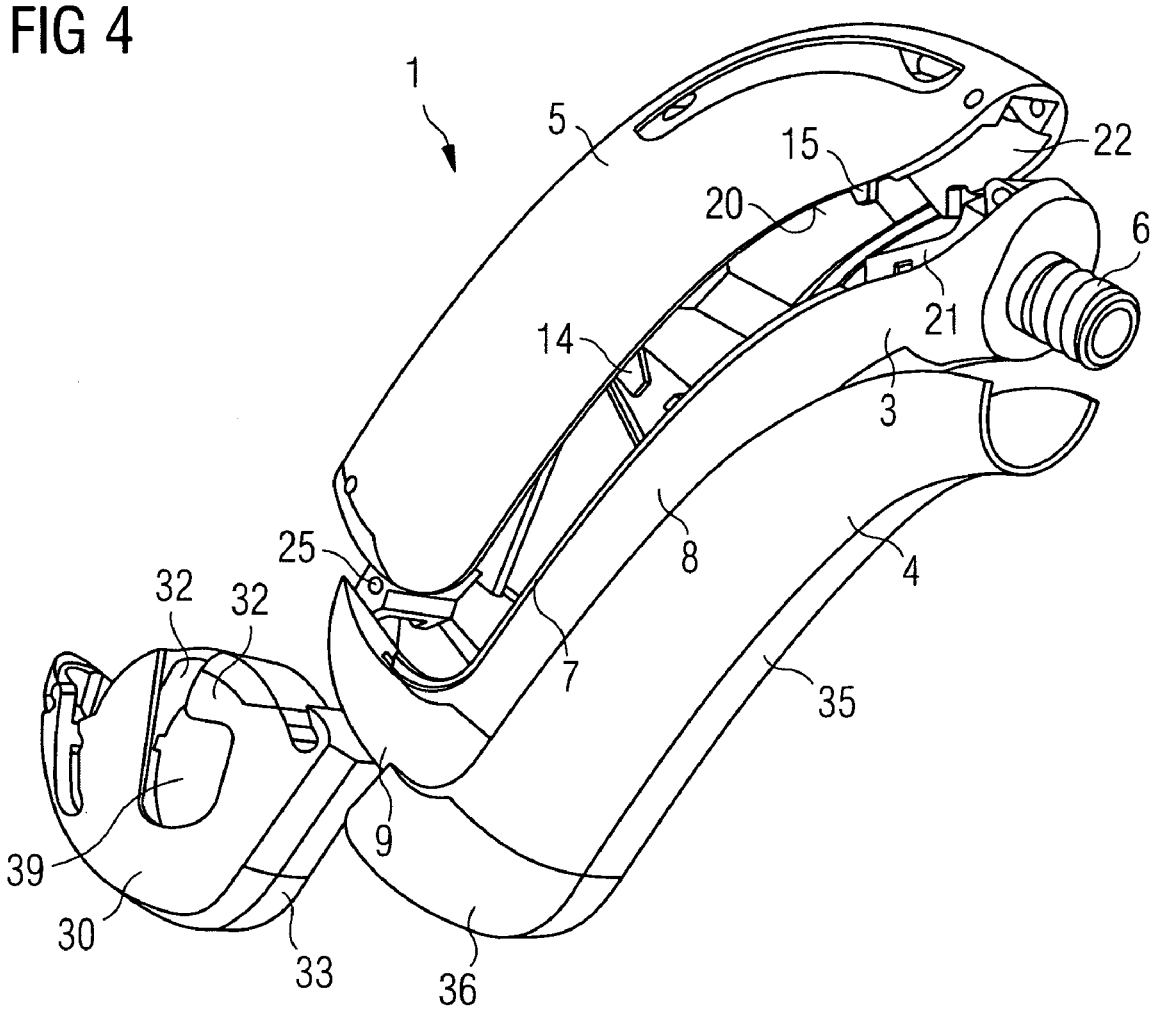
FIG. 4 shows a perspective illustration of the housing of the inventive hearing device having the housing elements; upper shell and first and second lower shells as well as a front-facing housing element.
Figure 5:
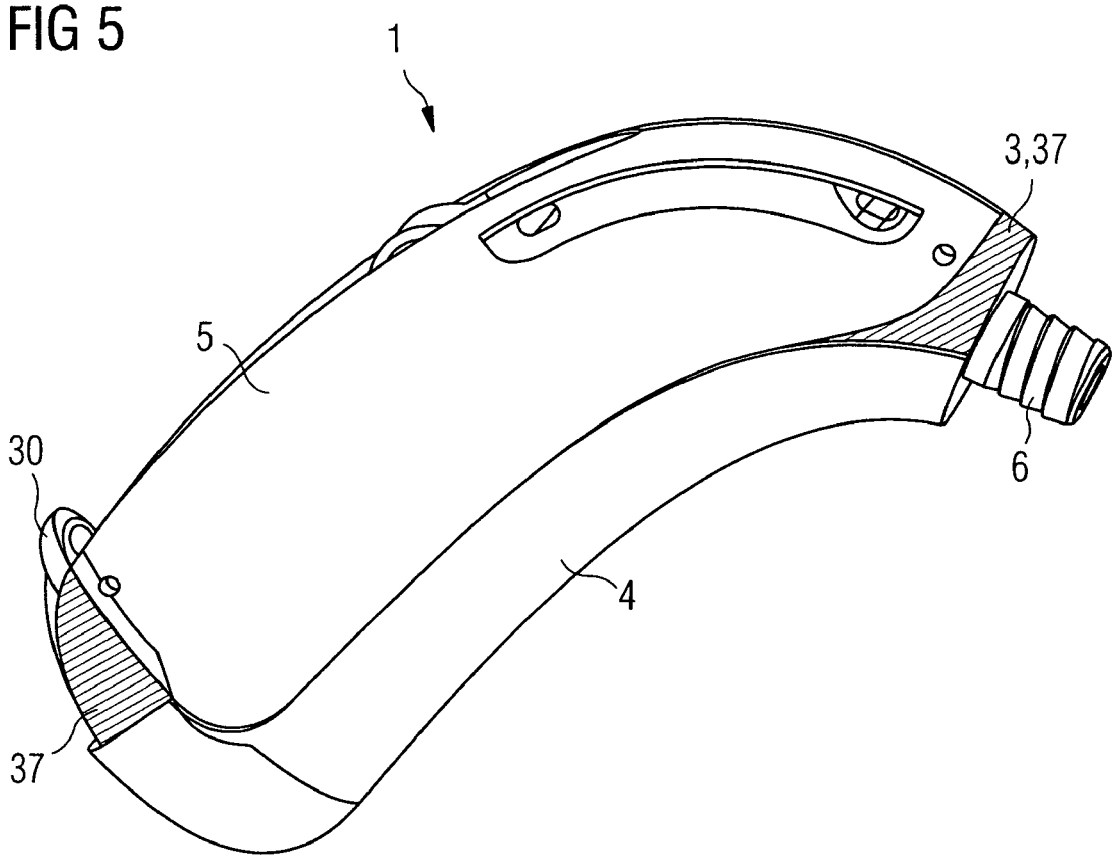
FIG. 5 shows a perspective illustration of the housing of the inventive hearing device in an assembled state without the carrier bar.

As FIG. 4 shows, the shaft element 9 which is open on the face side is closed by a housing element 30 on the face side. The housing element 30 has an opening 31 approximately centrally, which is delimited by a bifurcated insertion 32 of the housing element 30. During the assembly, the housing element 30 with its lower side 33 is inserted between the side walls 26, 27 of the shaft element 9 of the first lower shell 3 until the hook element 25 hooks into the opening 31 of the housing element 30 and/or its hook receptacle 31, 32. Here the first lower shell 3 is preferably already locked with the upper shell 5. In order to complete the housing 1, the second lower shell 4 can then be attached to the first lower shell 3, whereupon the housing 1 according to FIG. 5 is present.

The second lower shell 4 is made from an elastic plastic, and is embodied in a boot-like manner or angled like the first lower shell 3 and has a longish base element 35 and a shaft element 36 as the longer and shorter leg in each instance.

In accordance with the invention, the second lower shell 4 and the first lower shell 3 are releasably connected by means of elastically deforming the second lower shell 4. A frictional connection is produced by means of tensioning and/or applying pressure, which causes the second lower shell 4 to be reliably held against the first lower shell 3. A joining method thus exists, in which the joining components are essentially only elastically deformed and an unintentional release by means of a frictional or form-fit connection is prevented.

The shape of the second lower shell 4 essentially corresponds to the shape of the first lower shell 3. This thus results in the first lower shell 3 being completely covered by the second lower shell 4. Only the extension of the shaft element 36 of the second lower shell 4 is approximately less than the extension of the shaft element 9 of the first lower shell 3. The second lower shell 4 thus almost forms a sleeve for the first lower shell 3. As shown in more detail in FIG. 5, when the housing 1 is in the completed state, only minimal regions of the first lower shell 3 are not covered by the second lower shell 4, as is indicated in FIG. 5 by means of a hatching 37. Repeatedly attaching and detaching the second lower shell 4 to/from the first lower shell 3 is possible here.

This is thus advantageous in that an individual two-tone design combination is possible by simply 'clicking' and/or applying pressure to the second lower shell 4 against the first lower shell 3, e.g. in different colors. The sensitive electronics system always remains protected here in the first lower shell 3 and in the upper shell 5.

It is however also possible to change the color of the housing 1 completely, since the upper shell 5 is a relatively easily constructible plastic part. To this end, only the exchange of the upper shell 5 by a different-colored upper shell 5 which may if necessary be color-coordinated in respect of the second lower shell 4 is necessary.

The inventive design of the housing 1 allows the second lower shell 4 to be produced from a soft plastic. The use of a soft plastic also enables the shape of the second lower shell 4 to be configured individually, deviating from the illustration in the figures, e.g. according to a concha molding or a concha scanning. This is very user-friendly for a subsequent hearing device wearer, as pressure points on the ear can be avoided.

In order to protect against contamination, the surface of the second lower shell 4 can be embodied to be very smooth. It is also possible to coat the surface of the second lower shell 4 in a soil-resistant fashion in addition to or instead of the smooth embodiment. The coating can take place using nanotechnology, for instance as a so-called nano-coating, in order thus to achieve certain surface properties. Surfaces of this type contain tiny nano particles, which result in certain surface properties. Nano-coating designates the application of nanostructures onto surfaces. These surfaces are herewith super hydrophobic and thus water-resistant. This provides for easy cleaning. Spray coatings also exist, which form such nanostructures. If these coatings are applied to already correspondingly microstructured surfaces, a lotus effect can be achieved. Surfaces treated in this way also repel fat, oil and acids and are chemically stable (e.g. in respect of solvents).

The invention claimed is:

1. A behind the ear hearing device containing electromechanical components and/or electronic components, comprising:

a housing that accommodates the components, the housing constructed from: an upper shell, a first lower shell, and a second lower shell to be releasably fastened to the first lower shell, and the shape of the second lower shell largely corresponds to the shape of the first lower shell and when the second lower shell is assembled on the first lower shell, the second lower shell almost completely covers the first lower shell, wherein the upper shell is not covered by the second lower shell.

2. The hearing device as claimed in claim 1, wherein the second lower shell is releasably fastened to the first lower shell via a frictional connection.

3. The hearing device as claimed in claim 1, wherein the second lower shell is releasably fastened to the first lower shell via elastically deforming the second lower shell.

4. The hearing device as claimed in claim 3, wherein the releasable fastening to the first lower shell is provided by tensioning or applying pressure to the second lower shell made of elastic material.

5. The hearing device as claimed in claim 1, wherein the upper shell and the first lower shell are releasably connected to one another via a locking connection or snap-on connection.

6. The hearing device as claimed in claim 1, wherein the upper shell and the first lower shell are releasably connected to one another via a locking connection and snap-on connection.

7. The hearing device as claimed in claim 1, wherein a housing element on a front face is introduced into the first lower shell.

8. The hearing device as claimed in claim 7, wherein the housing element has a hook receptacle that hooks onto a hook element provided on the first lower shell.

9. The hearing device as claimed in claim 1, wherein the housing color of the hearing device is changeable by exchanging the second lower shell.

10. The hearing device as claimed in claim 9, wherein the upper shell is exchanged for changeable color design purposes.

11. The hearing device as claimed in claim 1, wherein the shape of the second lower shell is individually adjusted to the ear.

12. The hearing device as claimed in claim 11, wherein the second lower shell is made of a soft plastic.

13. The hearing device as claimed in claim 1, wherein the second lower shell has a smooth and coated surface.

14. The hearing device as claimed in claim 13, wherein the coated surface is made of a nano-coating.

15. The hearing device as claimed in claim 1, wherein the second lower shell has a smooth or coated surface.

16. The hearing device as claimed in claim 15, wherein the coated surface is made of a nano-coating.

* * * * *